US007128817B2

(12) United States Patent
Choi

(10) Patent No.: US 7,128,817 B2
(45) Date of Patent: Oct. 31, 2006

(54) FEED BELT FOR STRIP-SHAPED ELEMENTS

(75) Inventor: Kee Yol Choi, Puchun-Shi (KR)

(73) Assignee: JetTech Ltd., Kyunggo-do (KR)

( * ) Notice: Subject to any disclaimer, the term of this patent is extended or adjusted under 35 U.S.C. 154(b) by 414 days.

(21) Appl. No.: 10/723,092

(22) Filed: Nov. 25, 2003

(65) Prior Publication Data

US 2004/0104112 A1 Jun. 3, 2004

(30) Foreign Application Priority Data

Nov. 25, 2002 (KR) ..... 10-2002-0073411

(51) Int. Cl.
*C25D 17/06* (2006.01)

(52) U.S. Cl. ..... 204/206; 204/198; 204/202

(58) Field of Classification Search ..... 204/198, 204/202, 206

See application file for complete search history.

(56) References Cited

U.S. PATENT DOCUMENTS 4,534,843 A 8/1985 Johnson et al.
4,775,046 A * 10/1988 Gramarossa et al. ..... 198/803.8
4,779,877 A * 10/1988 Shaw ..... 279/4.04
4,948,486 A * 8/1990 Hosten ..... 204/198
4,958,983 A * 9/1990 Fisch ..... 414/795.3
4,983,088 A * 1/1991 Mundus ..... 414/27
5,024,745 A 6/1991 Rischke et al.
5,901,997 A * 5/1999 Bayer ..... 294/115
6,149,791 A * 11/2000 Roesener et al. ..... 205/122

* cited by examiner

*Primary Examiner*—Bruce F. Bell
(74) *Attorney, Agent, or Firm*—Jordan and Hamburg LLP

(57) ABSTRACT

A feed belt for strip-shaped elements includes a belt body and a plurality of fingers, the fingers being previously fabricated and coupled to the belt body at constant pitches. The belt body includes fitting openings and slits formed at one side of the fitting openings. Each fitting opening serves to be coupled with a fitting portion and an elastic hinge portion formed at one side of each finger. Each slit serves to be coupled with a bent gripper portion formed at the other side of the finger so as to allow movement of the bent gripper portion. The fitting portion and the elastic hinge portion of the finger, to be coupled into the fitting opening, are integrally formed. The bent gripper portion to be fitted into the slit is integrally connected with the elastic hinge portion through a direction conversion portion.

6 Claims, 7 Drawing Sheets

PRIOR ART

PRIOR ART

PRIOR ART

FEED BELT FOR STRIP-SHAPED ELEMENTS

BACKGROUND OF THE INVENTION

1. Field of the Invention

The present invention relates to a feed belt for strip-shaped elements, and more particularly to a feed belt, which is used for the transfer of strip-shaped elements in an automated large-scale in-line process including plating, deflashing and other various treatments for mass production of semiconductors or other products.

2. Description of the Related Art

In case of a conventional feed belt disclosed in U.S. Pat. No. 4,534,843, as shown in FIGS. 1 to 3, the feed belt, designated as reference numeral 1, comprises a belt body 2 and fingers 3 integrally formed to the belt body 2. Under this integral configuration, even if a part of the fingers 3 reach an unusable state as it is damaged in use or experiences a deterioration in its gripping force to be used to load a strip-shaped element 4 due to elastic attenuation, it is impossible to exchange the defective finger or fingers 3 only. Therefore, since the feed belt 1 has to be wholly replaced, the feed belt 1 is inefficient in maintenance as well as uneconomic due to its very short lifespan.

Further, according to the conventional feed belt 1 disclosed in U.S. Pat. No. 4,534,843, in a state wherein the fingers 3 are simultaneously pressed toward each other into horizontal pressing directions, designated by arrows X and Y, so as to define a certain space therebetween for loading/unloading of the strip-shaped element 4, the fingers 3 must be individually moved in order to raise or lower the strip-shaped element 4 in a vertical direction, designated by arrow Z, according to loading or unloading operation thereof, resulting in a complexity in the structure of peripheral facilities associated with the individual movement of the fingers 3, and an uneconomical increase in the size and cost of whole equipment. Therefore, the conventional feed belt 1 as stated above is rarely used these days.

Referring to FIGS. 4 and 5 illustrating another conventional feed belt disclosed in U.S. Pat. No. 5,024,745, the conventional feed belt 1 is manufactured by individually forming a belt body 2 and plural fingers 3, and separably coupling the fingers 3 to the belt body 2. This separable configuration has a structural problem in that a lower portion of each finger 3 has to be pressed upward in a pressing direction C as shown in FIG. 5 in order to load or unload the strip-shaped element 4. Due to this structural problem, the feed belt 1 often cause unstable malfunction as the fingers 3 are separated from coupling portions 5 where they are coupled to the belt body 2.

In order to simplify the whole structure of associated loading/unloading facilities as well as to reduce the overall size of the equipment, it is preferable that the fingers 3 are pressed in a horizontal direction perpendicular to the belt body 2 for loading/unloading of the strip-shaped element 4, but the conventional feed belt disclosed in U.S. Pat. No. 5,024,745 is not configured to satisfy this requirement, resulting in a complexity in the structure of the associated facilities and an uneconomical increase in the overall size and cost of the equipment as well as an increase in the possibility of failure. Therefore, the disclosed feed belt 1 is undesirable in view of maintenance.

Considering a coupling structure between the belt body 2 and the fingers 3 of the feed belt 1 disclosed in U.S. Pat. No. 5,024,745, since each finger 3 is configured so that its end gripper portions 6 move upward and downward about a hinge portion 7 centrally located at the finger 3, it is necessary to secure a certain space suitable for the movement of the gripper portions 6. Further, since a distance between the gripper portions 6 and the hinge portion 7 is relatively short, the finger 3 must be pressed upward across a relatively long distance exceeding a predetermined range in the pressing direction C in order to secure a sufficient loading space for the strip-shaped element 4. Furthermore, where the gripper portions 6 move downward so as to return to their original positions after being opened away from each other and again closed to each other for loading the strip-shaped element 4, the strip-shaped element 4 may be pushed or slide downward while being moved along with the gripper portions 6, thereby causing the strip-shaped element 4 to fail in loading thereof, or even if it is loaded, to be separated from the belt 1 during the transfer thereof due to its unstable loaded state.

In case of yet another conventional feed belt constructed as shown in FIGS. 6 and 7, the finger 3 of the feed belt comprises a support piece 8 formed by pressing a thin sheet, and elastic supports 9 formed by bending wires, which are separately formed and coupled to each other, resulting in a complexity in the structure of the finger 3. Consequently, the feed belt shown in FIGS. 6 and 7 deteriorates productivity and increases a consumed amount of materials thus increasing manufacturing costs as well as causing other uneconomical problems, and still cannot solve the basic malfunction problem caused during the loading or transfer of the strip-shaped element, in the same manner as that shown in FIGS. 4 and 5.

SUMMARY OF THE INVENTION

Therefore, the present invention has been made in view of the above problems, and it is an object of the present invention to provide a feed belt for strip-shaped elements, which is improved in a coupling manner between its belt body and fingers, thereby completely preventing the fingers from unintentionally separating from the belt body when they are pressed for loading/unloading of the strip-shaped elements, and preventing the strip-shaped elements from sliding from or being pushed by the fingers during loading thereof.

It is another object of the present invention to provide a feed belt for strip-shaped elements, which is improved in the structure of its fingers, each finger being configured so that its one side portion being capable of generating an elastic force for achieving displacement of a gripper portion formed at the other side of the finger so as to cause the finger to be pressed toward or released from the belt body, of serving as reference points of the displacement of the bent gripper portion, and of preventing unintentional separation between the finger and the belt body, the finger having an integral structure through the use of a wire, thereby facilitating the manufacture thereof thus reducing manufacturing costs, and considerably extending a lifespan of the belt body or fingers thus improving maintenance ability.

It is yet another object of the present invention to provide a feed belt, which is configured in such a way that its fingers are preferably pressed in a horizontal direction during loading or unloading of strip-shaped elements, or even if they are pressed in both horizontal and upward directions or in an inclined upward direction similar to the prior art if necessary, they securing accurate loading or unloading operation of the strip-shaped elements, thereby simplifying the structure of peripheral devices associated with the movement of the fingers compared with the prior art, resulting in a reduction in the overall manufacturing cost, and enabling to be used along with conventional existing loading or unloading devices.

In accordance with the present invention, the above and other objects can be accomplished by the provision of a feed belt for strip-shaped elements in an automated large-scale in-line process including plating, deflashing and other various treatments for mass production of semiconductors or other products, comprising: a belt body; and a plurality of fingers, the fingers being previously fabricated and coupled to the belt body at constant pitches, wherein the belt body includes fitting openings and slits formed at one side of the fitting openings, each fitting opening serving to be coupled with a fitting portion and an elastic hinge portion formed at one side of each finger, each slit serving to be coupled with a bent gripper portion formed at the other side of the finger so as to allow movement of the bent gripper portion, and wherein the fitting portion and the elastic hinge portion of the finger, to be coupled into the fitting opening, are integrally formed, and the bent gripper portion to be fitted into the slit is integrally connected with the elastic hinge portion through a direction conversion portion.

Preferably, a pair of the fingers may be connected to each other about their fitting portions so that their elastic hinge portions, direction conversion portions, and bent gripper portions face each other, respectively, or the elastic hinge portion, direction conversion portion and bent gripper portion may be integrally connected to one another so as to form a single structure while remaining the fitting portion.

Preferably, the elastic hinge portion of the finger may have a coiled spring shape, and be coupled with the fitting portion, thereby forming a coupling portion therebetween, the coupling portion forming an acute angle so as to achieve firm coupling between the finger and the belt body, and the elastic hinge portion may have a diameter larger than a vertical length of the fitting opening formed at the belt body.

Preferably, the direction conversion portion of the finger may have a coiled spring shape, or a simple curved shape.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
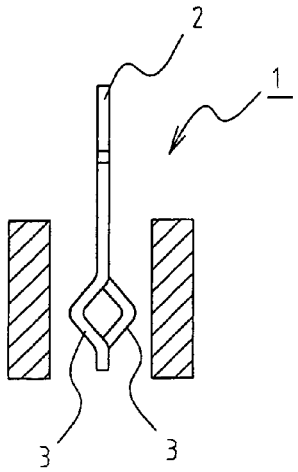
FIGS. 1 to 3 illustrate one example of conventional feed belts, FIG. 1 being a side view illustrating an initial state not achieving loading or unloading of a strip-shaped element, FIG. 2 being a side view illustrating a state just before loading or just after unloading of the strip-shaped element, and FIG. 3 being a side view illustrating a loaded state of the strip-shaped element.
Figure 2:
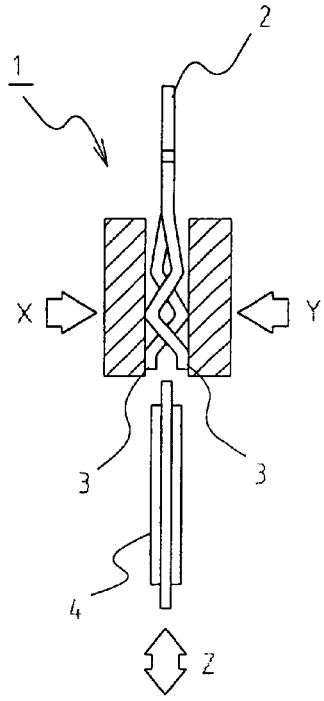
PRIOR ART FIG. 2
Figure 3:
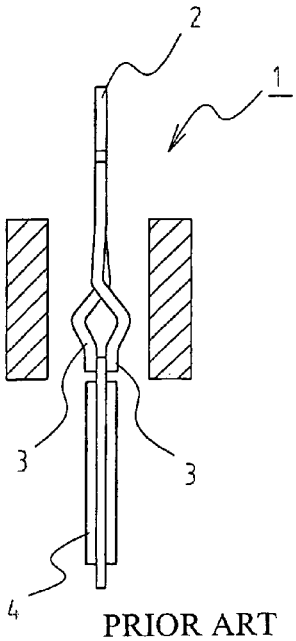
PRIOR ART FIG. 3
Figure 4:
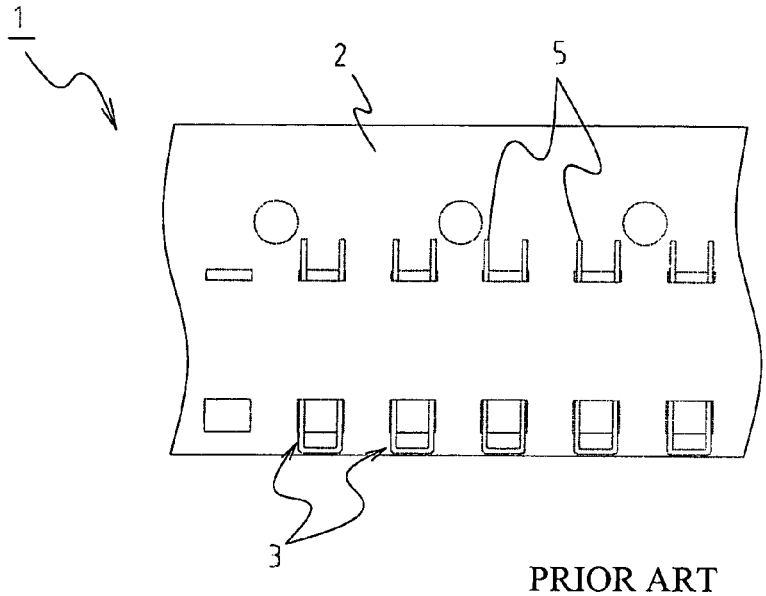
FIGS. 4 and 5 illustrate another example of conventional feed belts, FIG. 4 being a partially cut-away front view, and FIG. 5 being a partially cut-away side view of FIG. 4.
Figure 5:
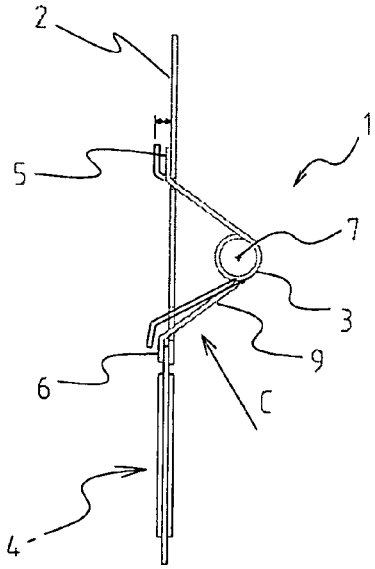
PRIOR ART FIG. 5
Figure 6:
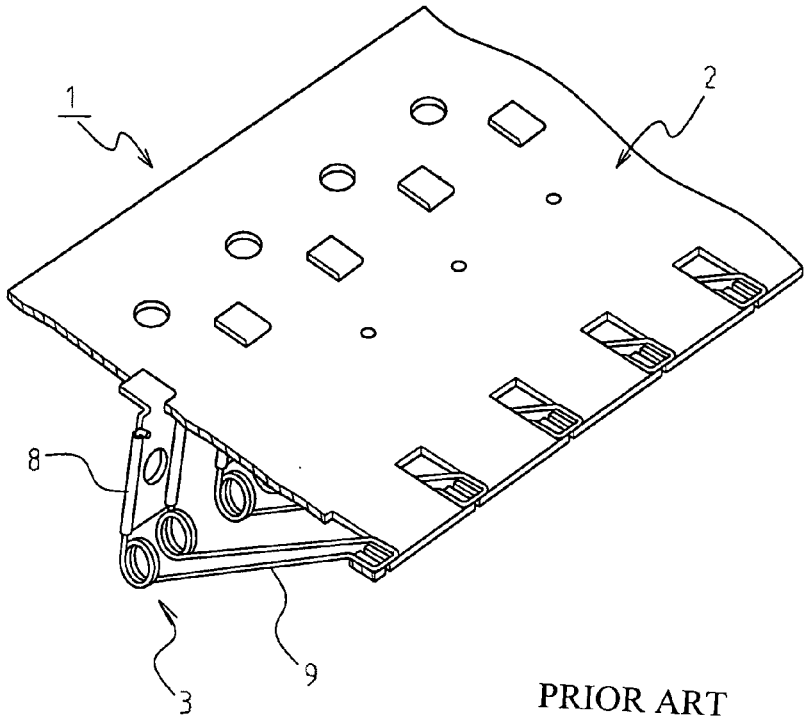
FIGS. 6 and 7 illustrate yet another example of conventional feed belts, FIG. 6 being a partially cut-away perspective view, and FIG. 7 being a partially cut away side view of FIG. 6.
Figure 7:
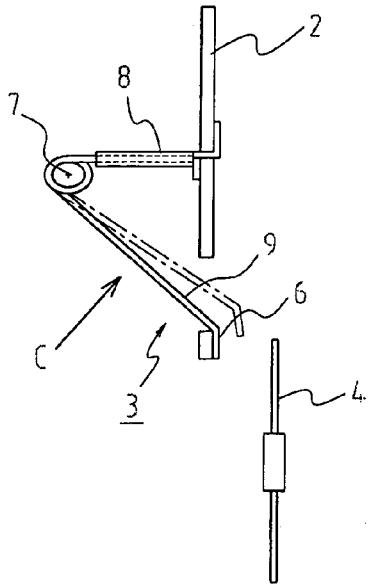
PRIOR ART FIG. 7
Figure 8:
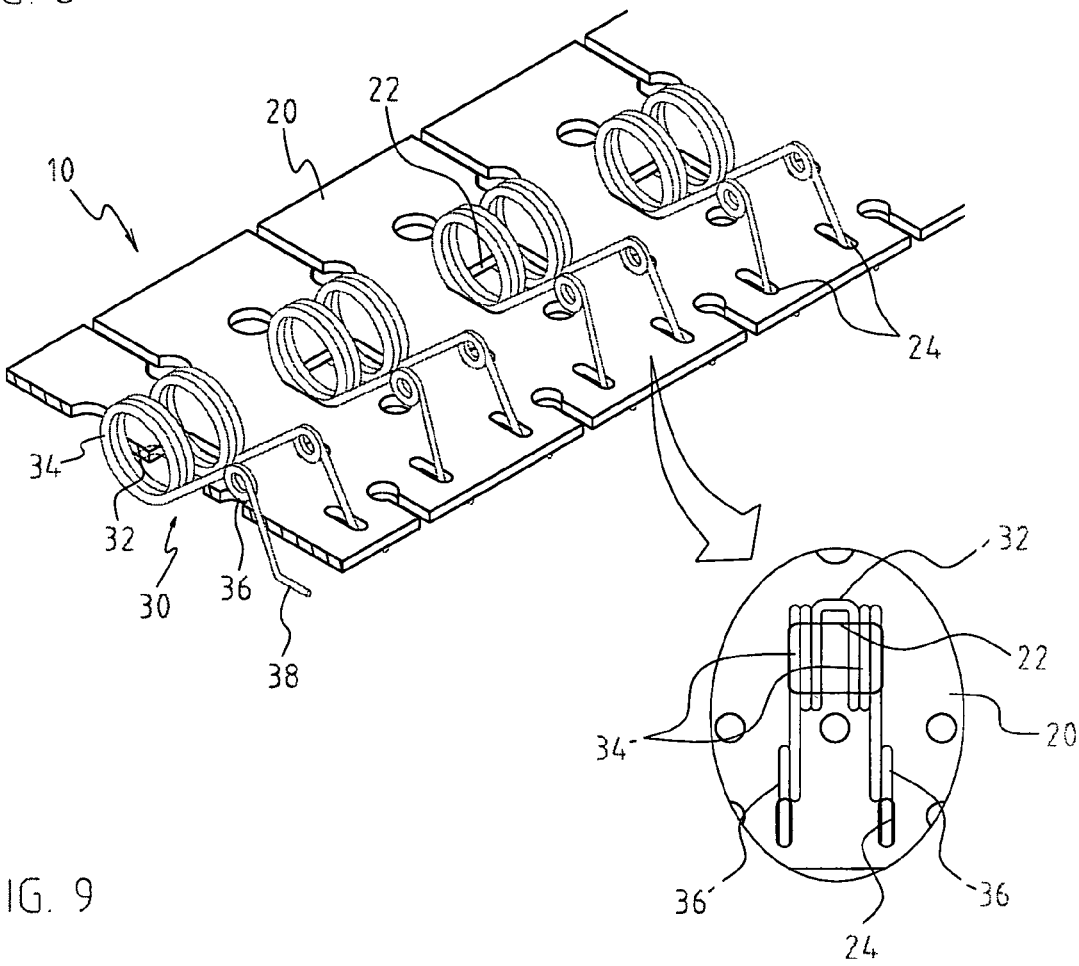
FIG. 8 is a partially cut-away perspective view illustrating a feed belt in accordance with a preferred embodiment of the present invention.

In case of feed belts 10 in accordance with various preferred embodiments as shown in FIGS. 8 to 14, they are commonly constructed by coupling a plurality of previously fabricated fingers 30 to a belt body 20 at constant pitches. The belt body 20 is formed with fitting openings 22, into which a fitting portion 32 and an elastic hinge portion 34 of each finger 30 is fitted and coupled, respectively. The belt body 20 is further formed with slits 24 at one side of the fitting openings 22, into which a bent gripper portion 38 of each finger 30 is fitted in a movable manner, respectively. The fitting portion 32 and the elastic hinge portion 34 of the finger 30, to be coupled into the fitting opening 22, are integrally formed, and the bent gripper portion 38, to be fitted into the slit 24, is integrally connected with the elastic hinge portion 34 through a direction conversion portion 36.

A pair of the fingers 30 are connected to each other about their fitting portions 32, as shown in FIGS. 8 to 13, so that their elastic hinge portions 34 and 34, direction conversion portions 36 and 36, and bent gripper portions 38 and 38 face each other, respectively. Alternatively, as shown in FIG. 14, the fitting portion 32 of the finger 30 is individually installed, and the remaining elastic hinge portion 34, direction conversion portion 36 and bent gripper portion 38 are integrally connected to one another, thereby taking in the form of a single structure.

The elastic hinge portion 34 of the finger 30 is formed to have a coiled spring shape, and is coupled with the fitting portion 32, thereby forming a coupling portion 33 therebetween. The coupling portion 33 forms an acute angle so as to achieve firm coupling between the finger 30 and the belt body 20. The elastic hinge portion 34 has a diameter larger than a vertical length of the fitting opening 22 formed at the belt body 20, so that a part of the elastic hinge portion 34 can be supported by the belt body 20 while being fitted in the fitting opening 22.

Figure 10:
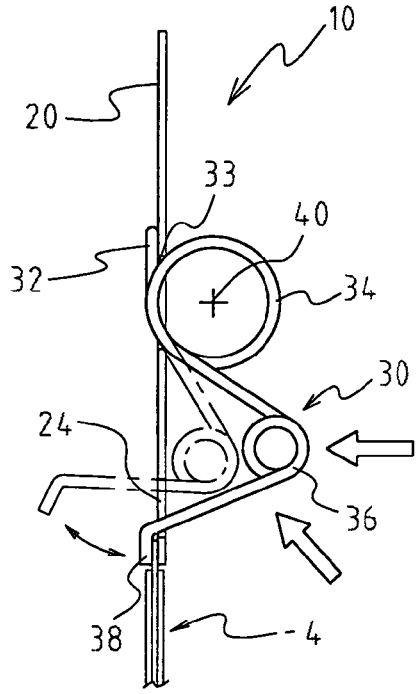
FIG. 10 is a partially cut-away side view illustrating another operating state of FIG. 9.
Figure 11:
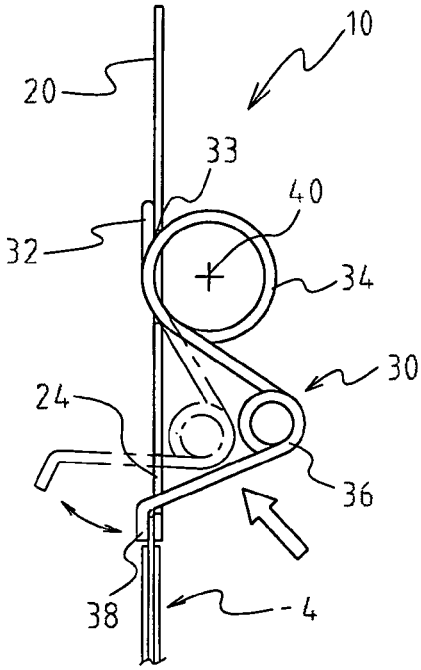
FIG. 11 is a partially cut-away side view illustrating yet another operating state of FIG. 9.
Figure 12:
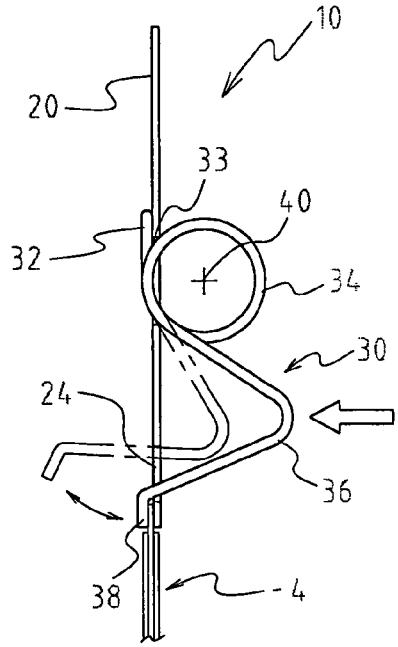
FIG. 12 is a partially cut-away side view illustrating a feed belt in accordance with another preferred embodiment of the present invention, shown corresponding to FIG. 9.
Figure 13:
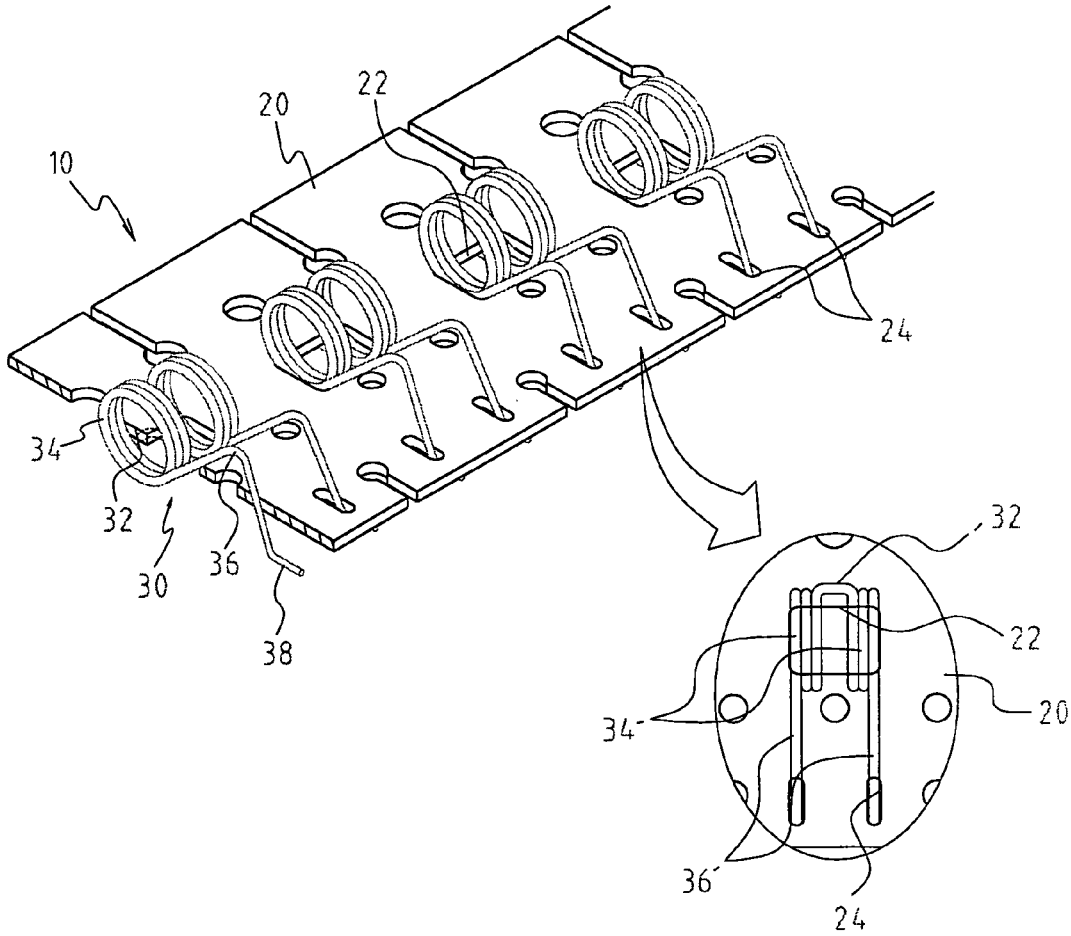
FIG. 13 is a partially cut-away perspective view of FIG. 12.
Figure 14:
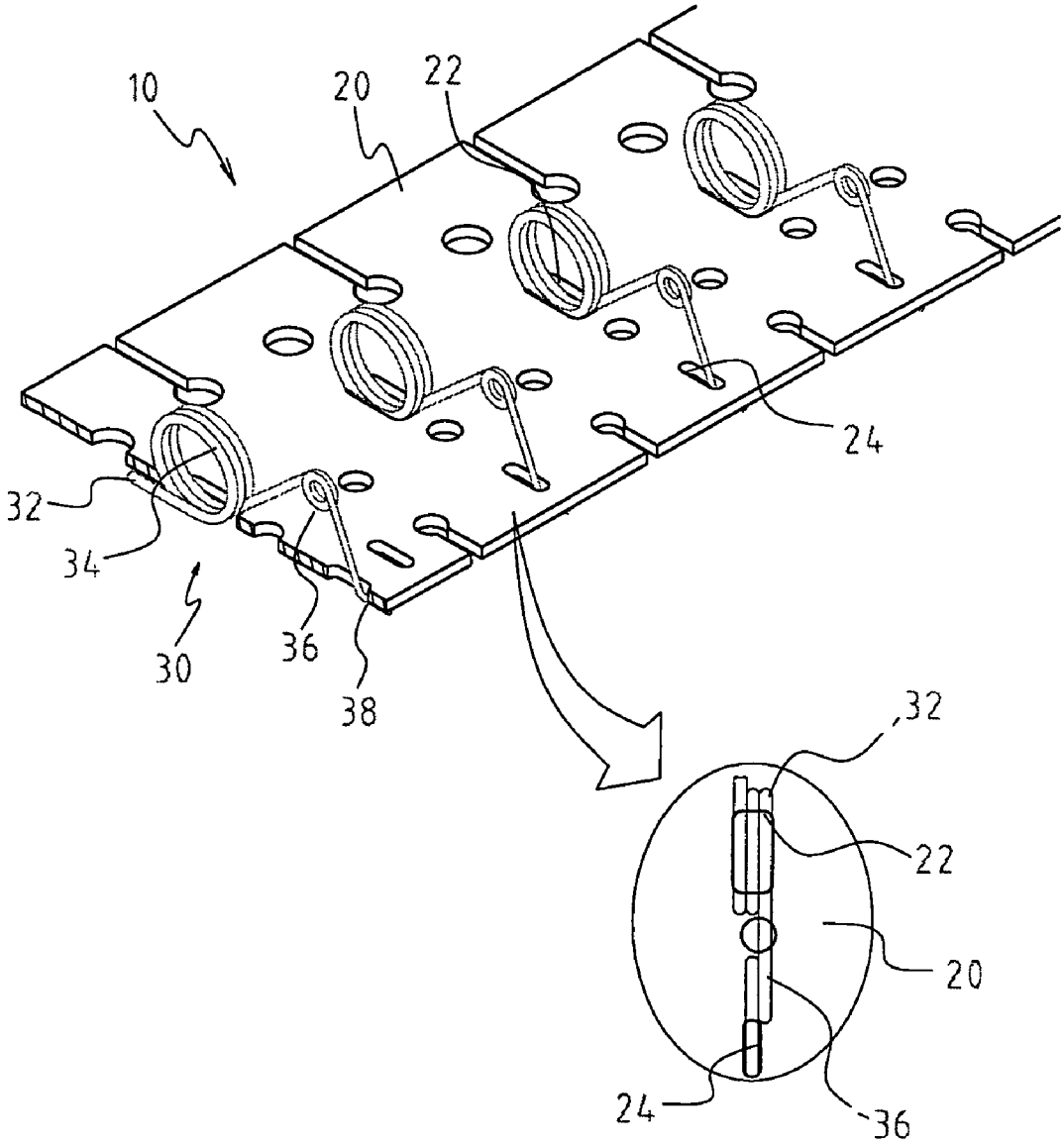
FIG. 14 is a partially cut-away perspective view illustrating a feed belt in accordance with yet another preferred embodiment of the present invention.

The direction conversion portion 36 of the finger 30 may be formed to have a coiled spring shape as shown in FIGS. 8 to 11, or to have a simple curved shape as shown in FIGS. 12 to 14.

Un-described reference numeral 40 denotes an imaginary center point of the elastic hinge portion 34 of the finger 30.

The operation of the present invention configured as stated above will be explained.

When it is desired to form the feed belt 10 by coupling the fingers 30 to the belt body 20, the fitting portion 32 of each finger 30 is first fitted from the upper side of the fitting opening 22 formed at the belt body 20 so that the coupling portion 33 between the fitting portion 32 and the elastic hinge portion 34 of the finger 30 is caught by the edge of the fitting opening 22, and a part of the elastic hinge portion 34 is fitted inside the fitting opening 22. As the bent gripper portion 38 of the finger 30 is fitted and coupled in the slit 24, the coupling procedure of the finger 30 to the belt body 20 is completed. The finger 30 is supported at the belt body 20 according to interrelation between the fitting portion 32 and the elastic hinge portion 34 forming the coupling portion 33 and the fitting opening 22 of the belt body 20, and the bent gripper portion 38 of the finger 30 is elastically displaceable about the elastic hinge portion 34.

Figure 9:
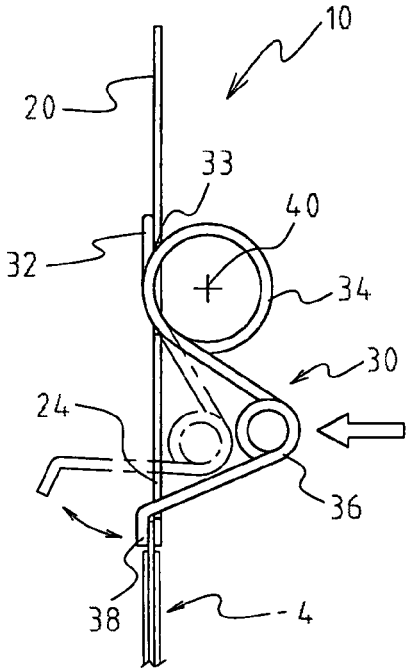
FIG. 9 is a partially cut-away side view of FIG. 8 illustrating an operating state of the feed belt in accordance with the preferred embodiment of the present invention.

Considering the loading procedure of the strip-shaped element 4, first the finger 30 may be pressed in a horizontal direction as shown in FIGS. 9 and 12, or may be pressed in both horizontal and upward directions as shown in FIG. 10, or may be pressed in an inclined upward direction as shown in FIG. 11. Among the above pressing manners, it is preferable that the finger 30 is pressed in a horizontal direction as shown in FIGS. 9 and 12 so as to secure a sufficient loading space between the belt body 20 and the bent gripper portion 38 of the finger 30 for preparing a loading operation.

After the strip-shaped element 4 to be loaded is located in the loading space defined by pressing the finger 30 as stated above, as the bent gripper portion 38 is returned to its original position by releasing the finger 3 from its pressed state, the strip-shaped element 4 is gripped in the loading space between the belt body 20 and the bent gripper portion 38.

During the bent gripper portion 38 of the finger 30 is separated from the belt body 20 by again pressing the finger 30, the bent gripper portion 38 is angularly displaced about the center point 40 of the elastic hinge portion 40 by receiving an elastic force transmitted from the elastic hinge portion 40. In this case, since a distance between the center point 40 of the elastic hinge portion 40 and the bent gripper portion 38 is relatively long, even if the finger 30 is pressed across a relatively short distance, the bent gripper portion 38 can move away from the belt body 20 by a relatively long distance, thereby securing an easy formation of the loading space for the strip-shaped element 4. Further, when the bent gripper portion 38 is returned toward its original position by releasing the finger 30 from its pressed state, there is no generation of forcible downward movement of the strip-shaped element 4, thereby securing a more firm loading operation of the strip-shaped element 4.

A detailed description related to the unloading operation of the strip-shaped element 4 will be omitted since it is performed conversely to the loading operation as stated above. That is, as the bent gripper portion 38 is pressed and moved forward by pressing the finger 30, the strip-shaped element 4 is unloaded, and the bent gripper portion 38 is returned to its original position by releasing the finger 30 from its pressed state.

As apparent from the above description, the present invention provides a feed belt for strip-shaped elements, which is improved in a coupling manner or structure between its belt body and fingers, thereby completely preventing the fingers from unintentionally separating from the belt body when they are pressed for loading/unloading of the strip-shaped elements, and preventing the strip-shaped elements from sliding from or being pushed by the fingers during loading thereof.

Further, according to the present invention, each finger comprises a fitting portion and an elastic hinge portion, which are formed at one side of the finger and coupled to each other to form a coupling portion relative to the belt body. By virtue of interrelation between the fitting portion, elastic hinge portion and coupling portion of the finger and one of fitting openings formed at the belt body, these one side components of the finger can generate an elastic force for achieving displacement of a gripper portion formed at the other side of the finger so as to cause the finger to be pressed toward or released from the belt body, can serve as reference points of the displacement of the bent gripper portion, and can prevent unintentional separation between the finger and the belt body.

Furthermore, since the respective components of the finger are integrally formed by the use of a wire, it is possible to facilitate the manufacture of the finger thus reducing manufacturing costs, and to considerably extend a lifespan of the belt body or fingers thus improving maintenance ability.

In addition, the feed belt of the present invention is configured so that the all fingers are preferably pressed in a horizontal direction during loading or unloading of strip-shaped elements, thereby simplifying the structure of peripheral devices associated with loading or unloading operation, and reducing the overall manufacturing costs of whole equipment. If necessary, the fingers may be simultaneously pressed in both horizontal and upward directions, or in an inclined upward direction similar to the prior art for loading or unloading the strip-shaped elements. This enables conventional existing loading or unloading devices to be used that of the present invention thus widening the application thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A feed belt for strip-shaped elements in an automated large-scale in-line process including plating, deflashing and other various treatments for mass production of semiconductors or other products, comprising:

a belt body; and a plurality of fingers, the fingers being previously fabricated and coupled to the belt body at constant pitches, wherein the belt body includes fitting openings and slits formed at one side of the fitting openings, each fitting opening serving to be coupled with a fitting portion and an elastic hinge portion formed at one side of each finger, each slit serving to be coupled with a bent gripper portion formed at the other side of the finger so as to allow movement of the bent gripper portion, and wherein the fitting portion and the elastic hinge portion of the finger, to be coupled into the fitting opening, are integrally formed, and the bent gripper portion to be fitted into the slit is integrally connected with the elastic hinge portion through a direction conversion portion.

2. The belt as set forth in claim 1, wherein a pair of the fingers are connected to each other about their fitting portions so that their elastic hinge portions, direction conversion portions, and bent gripper portions face each other, respectively.

3. The belt as set forth in claim 1, wherein the elastic hinge portion, direction conversion portion and bent gripper portion are integrally connected to one another so as to form a single structure while remaining the fitting portion.

4. The belt as set forth in claim 1, wherein: the elastic hinge portion of the finger has a coiled spring shape, and is coupled with the fitting portion, thereby forming a coupling portion therebetween, the coupling portion forming an acute angle so as to achieve firm coupling between the finger and the belt body; and the elastic hinge portion has a diameter larger than a vertical length of the fitting opening formed at the belt body, whereby a part of the elastic hinge portion can be supported by the belt body while being fitted in the fitting opening.

5. The belt as set forth in claim 1, wherein the direction conversion portion of the finger has a coiled spring shape.

6. The belt as set forth in claim 1, wherein the direction conversion portion of the finger has a simple curved shape.

* * * * *